US011690159B2

(12) United States Patent
Rollinger et al.

(10) Patent No.: US 11,690,159 B2
(45) Date of Patent: Jun. 27, 2023

(54) APPARATUS AND METHOD FOR EXTENDING TARGET MATERIAL DELIVERY SYSTEM LIFETIME

(71) Applicant: ASML Netherlands B.V., Veldhoven (NL)

(72) Inventors: Bob Rollinger, San Diego, CA (US); Georgiy Olegovich Vaschenko, San Diego, CA (US); Chirag Rajyaguru, San Diego, CA (US); Alexander Igorevich Ershov, Escondido, CA (US); Joshua Mark Lukens, San Diego, CA (US); Mathew Cheeran Abraham, San Diego, CA (US)

(73) Assignee: ASML Netherlands B.V., Veldhoven (NL)

( * ) Notice: Subject to any disclaimer, the term of this patent is extended or adjusted under 35 U.S.C. 154(b) by 0 days.

(21) Appl. No.: 17/284,060

(22) PCT Filed: Oct. 25, 2019

(86) PCT No.: PCT/US2019/058110
§ 371 (c)(1),
(2) Date: Apr. 9, 2021

(87) PCT Pub. No.: WO2020/092162
PCT Pub. Date: May 7, 2020

(65) Prior Publication Data

US 2021/0392733 A1 Dec. 16, 2021

Related U.S. Application Data

(60) Provisional application No. 62/752,116, filed on Oct. 29, 2018.

(51) Int. Cl.
*H05G 2/00* (2006.01)

(52) U.S. Cl.
CPC ..... *H05G 2/006* (2013.01)

(58) Field of Classification Search
CPC ..... H05G 2/006
See application file for complete search history.

(56) References Cited

U.S. PATENT DOCUMENTS 6,912,267 B2 6/2005 Orsini et al.
8,513,629 B2 8/2013 Rajyaguru et al.
(Continued)

FOREIGN PATENT DOCUMENTS

WO 2017102931 A1 6/2017

OTHER PUBLICATIONS

Chiara Giovanardi, European International Searching Authority, International Search Report and Written Opinion, corresponding PCT Application No. PCT/US2019/058110, dated Mar. 13, 2020, 13 pages total.

*Primary Examiner* — Nicole M Ippolito
*Assistant Examiner* — Hanway Chang
(74) *Attorney, Agent, or Firm* — DiBerardino McGover IP Group LLC

(57) ABSTRACT

Disclosed is a system for generating EUV radiation in which current flowing through target material in the orifice 320 of a nozzle in a droplet generator is controlled by providing alternate lower impedance paths for the current and/or by limiting a high frequency component of a drive signal applied to the droplet generator.

20 Claims, 5 Drawing Sheets

(56) References Cited

U.S. PATENT DOCUMENTS

| | | | | |
|---|---|---|---|---|
| 8,710,474 | B2 | 4/2014 | Kodama et al. | |
| 2009/0014668 | A1 | 1/2009 | Vaschenko | |
| 2009/0230326 | A1 | 9/2009 | Vaschenko et al. | |
| 2012/0286176 | A1 | 11/2012 | Rajyaguru et al. | |
| 2013/0062538 | A1 | 3/2013 | Kodama et al. | |
| 2014/0102875 | A1 | 4/2014 | De Dea et al. | |
| 2015/0230325 | A1* | 8/2015 | Fleurov ..... | H05G 2/008 250/214.1 |

* cited by examiner

APPARATUS AND METHOD FOR EXTENDING TARGET MATERIAL DELIVERY SYSTEM LIFETIME

CROSS-REFERENCE TO RELATED APPLICATIONS

This application claims priority of U.S. application 62/752,116 which was filed on Oct. 29, 2018 and which is incorporated herein in its entirety by reference.

FIELD

The present disclosure relates to apparatus for and methods of generating extreme ultraviolet ("EUV") radiation from a plasma created through discharge or laser ablation of a target material in a vessel. In such applications optical elements are used, for example, to collect and direct the radiation for use in semiconductor photolithography and inspection.

BACKGROUND

Extreme ultraviolet radiation, e.g., electromagnetic radiation having wavelengths of around 50 nm or less (also sometimes referred to as soft x-rays), and including radiation at a wavelength of about 13.5 nm, can be used in photolithography processes to produce extremely small features in substrates such as silicon wafers.

Methods for generating EUV radiation include converting a target material to a plasma state. The target material preferably includes at least one element, e.g., xenon, lithium or tin, with one or more emission lines in the EUV portion of the electromagnetic spectrum. The target material can be solid, liquid, or gas. One technique involves generating a stream of target material droplets and irradiating at least some of the droplets with one or more laser radiation pulses. Such sources generate EUV radiation by coupling laser energy into a target material having at least one EUV emitting element, creating a highly ionized plasma with electron temperatures of several 10's of eVs.

One technique for generating droplets involves melting a target material such as tin and then forcing it under high pressure through a relatively small diameter orifice, such as an orifice having a diameter of about 0.5 μm to about 30 μm, to produce a stream of droplets having droplet velocities in the range of about 30 m/s to about 150 m/s. Under most conditions, in a process called Rayleigh breakup, instabilities in the stream exiting the orifice, will cause the stream to break up into droplets. These droplets may have varying velocities and may combine with each other to coalesce into larger droplets.

In the EUV generation processes under consideration here, it is desirable to control the break up/coalescence process. For example, in order to synchronize the droplets with the optical pulses of a drive laser, a repetitive disturbance with an amplitude exceeding that of the random noise may be applied to the continuous stream. By applying a disturbance at the same frequency (or its higher harmonics) as the repetition rate of the pulsed laser, the droplets can be synchronized with the laser pulses. For example, the disturbance may be applied to the stream by coupling an electro-actuatable element (such as a piezoelectric material) to the stream and driving the electro-actuatable element with a periodic waveform. In one embodiment, the electro-actuatable element will contract and expand in diameter (on the order of nanometers). This change in dimension is mechanically coupled to a structure defining a cavity such as a tube or capillary that undergoes a corresponding contraction and expansion of diameter. The column of target material. e.g., molten tin, inside the cavity also contracts and expands in diameter (and expands and contracts in length) to induce a velocity perturbation in the stream at the nozzle exit.

As used herein, the term "electro-actuatable element" and its derivatives, means a material or structure which undergoes a dimensional change when subjected to a voltage, electric field, magnetic field, or combinations thereof and includes, but is not limited to, piezoelectric materials, electrostrictive materials, and magnetostrictive materials. Apparatus for and methods of using an electro-actuatable element to control a droplet stream are disclosed, for example, in U.S. Patent Application Publication No. 2009/0014668 A1, titled "Laser Produced Plasma EUV Light Source Having a Droplet Stream Produced Using a Modulated Disturbance Wave" and published Jan. 15, 2009, and U.S. Pat. No. 8,513,629, titled "Droplet Generator with Actuator Induced Nozzle Cleaning" and issued Aug. 20, 2013, both of which are hereby incorporated by reference in their entirety.

The task of the droplet generator is thus to place properly sized droplets in the primary focus where they will be used for EUV production. The droplets must arrive at primary focus within certain spatial and temporal stability criteria, that is, with position and timing that is repeatable within acceptable margins. They must also arrive at a given frequency and velocity. Furthermore, the droplets must be fully coalesced, meaning that the droplets must be monodisperse (of uniform size) and arrive at the given drive frequency. For example, the droplet stream should be free of on-axis "satellite" droplets, that is, smaller droplets of target material that have failed to coalesce into a main droplet. Meeting these criteria is complicated by the fact that droplet generator performance changes over time. For example, when the performance of the droplet generator changes, it may produce droplets that are not fully coalesced by the time they reach the primary focus. Eventually the droplet generator performance will deteriorate to the point that the droplet generator must be taken offline for maintenance or replacement.

Another failure mode of such a droplet generator is a gradual drift of the droplet stream angle. Such drift creates instability of the EUV source operation and in some instances results in a loss of the droplets when the angle becomes too large and the droplets start clipping the exit aperture of the droplet generator. Such drift tends to be unidirectional drift and can grow until a droplet generator steering system runs out of range to correct droplet position or until droplets are clipped by the exit aperture. This loss of droplets leads to a droplet generator swap, which affects overall system availability.

There is thus a need to extend the lifetime of such droplet generators in order to increase system availability.

SUMMARY

The following presents a summary of one or more embodiments in order to provide a basic understanding of the embodiments. This summary is not an extensive overview of all contemplated embodiments and is not intended to identify key or critical elements of all embodiments nor set limits on the scope of any or all embodiments. Its sole purpose is to present some concepts of one or more embodiments in a simplified form as a prelude to the more detailed description that is presented later.

Disclosed is a system for generating EUV radiation in which current flowing through target material in the orifice of a nozzle in a droplet generator is controlled by providing alternate lower impedance paths for the current and/or by limiting a high frequency component of a drive signal applied to the droplet generator.

According to one aspect of an embodiment there is disclosed an apparatus for generating EUV radiation comprising a target material dispenser, the target material dispenser comprising a structure defining a cavity arranged to receive target material and an orifice arranged to receive target material from the cavity and to deliver a stream of droplets of target material, an electro-actuatable element mechanically coupled to the cavity and arranged to induce velocity perturbations in the stream of droplets based on a drive signal, and a drive signal generator electrically coupled to the electro-actuatable element for supplying the drive signal, electrical connections with the electro-actuatable element being arranged to control an amount of current flowing through the target material at the orifice. The electrical connections with the electro-actuatable element may be arranged to provide a low impedance path between the electro-actuatable element and ground that does not pass through the target material at the orifice. The structure defining a cavity may comprise a cylindrical tube and the electro-actuatable element comprises a cylindrical piezoelectrical element arranged around the cylindrical tube and having an inner surface connected to ground by a low impedance path. The target material dispenser may further comprise a conductive coating around at least part of the structure defining a cavity. The conductive coating may have a resistivity less than about 1E-06 Ohm-m. The conductive coating may be limited to an area of the structure defining including the orifice. The electro-actuatable element may be positioned around a first axial portion of the cavity not having a conductive coating. The conductive coating may be connected to ground through a low impedance path. The apparatus may further comprise an insulating coating on top of the conductive coating. The drive signal generator may be electrically coupled to the electro-actuatable element through an RF coaxial cable terminated directly at the electro-actuatable element.

According to another aspect of an embodiment there is disclosed an apparatus for generating EUV radiation comprising a target material dispenser a target material dispenser, the target material dispenser comprising a structure defining a cavity arranged to receive target material and an orifice arranged to receive target material from the cavity and to deliver a stream of droplets of target material, an electro-actuatable element mechanically coupled to the cavity and arranged to induce velocity perturbations in the stream of droplets based on a drive signal, and a drive signal generator electrically coupled to the electro-actuatable element for supplying the drive signal, wherein the highest frequency component of the drive signal is limited to a value in a range of about 3.5 MHz to about 7 MHz.

According to another aspect of an embodiment there is disclosed an apparatus for generating EUV radiation comprising a target material dispenser, the target material dispenser comprising a structure defining a cavity arranged to receive target material and an orifice arranged to receive target material from the cavity and to deliver a stream of droplets of target material, an electro-actuatable element mechanically coupled to the cavity and arranged to induce velocity perturbations in the stream of droplets based on a drive signal, and a drive signal generator electrically coupled to the electro-actuatable element for supplying the drive signal, wherein a minimum rise/fall time of the drive signal is in the range of about 50 ns to about 100 ns.

According to another aspect of an embodiment there is disclosed an apparatus for generating EUV radiation comprising a target material dispenser, the target material dispenser comprising a structure defining a cavity arranged to receive target material and an orifice arranged to receive target material from the cavity and to deliver a stream of droplets of target material, an electro-actuatable element mechanically coupled to the cavity and arranged to induce velocity perturbations in the stream of droplets based on a drive signal, and a drive signal generator electrically coupled to the electro-actuatable element for supplying the drive signal, wherein a maximum voltage of the drive signal is limited to limit a flow of current through target material in the orifice.

According to another aspect of an embodiment there is disclosed an apparatus for generating EUV radiation comprising a target material dispenser, the target material dispenser comprising a structure defining a cavity arranged to receive target material and an orifice arranged to receive target material from the cavity and to deliver a stream of droplets of target material, an electro-actuatable element mechanically coupled to the cavity and arranged to induce velocity perturbations in the stream of droplets based on a drive signal, and a drive signal generator electrically coupled to the electro-actuatable element for supplying the drive signal, wherein the drive signal includes a substantially constant DC bias. The bias may be negative. The bias may be positive. The bias may be negative if the drive waveform is comprised of pulses with positive plurality and positive if the drive waveform is comprised of pulses with negative plurality.

According to another aspect of an embodiment there is disclosed an apparatus for generating a target material dispenser, the target material dispenser comprising a structure defining a cavity arranged to receive target material and an orifice arranged to receive target material from the cavity and to deliver a stream of droplets of target material, an electro-actuatable element mechanically coupled to the cavity and arranged to induce velocity perturbations in the stream of droplets based on a drive signal, and a drive signal generator electrically coupled to the electro-actuatable element for supplying the drive signal, wherein the highest frequency component of the drive signal is limited to a value in a range of about 3.5 MHz to about 7 MHz; and electrical connections with the electro-actuatable element being arranged to control an amount of current flowing through the target material at the orifice.

According to another aspect of an embodiment there is disclosed an apparatus for generating EUV radiation comprising target material dispenser, the target material dispenser comprising a structure defining a cavity arranged to receive target material and an orifice arranged to receive target material from the cavity and to deliver a stream of droplets of target material, an electro-actuatable element mechanically coupled to the cavity and arranged to induce velocity perturbations in the stream of droplets based on a drive signal, and a drive signal generator electrically coupled to the electro-actuatable element for supplying the drive signal, electrical connections with the electro-actuatable element being arranged and a parameter of the drive signal being selected to control an amount of current flowing through the target material at the orifice.

According to another aspect of an embodiment there is disclosed a method of dispensing target material in an apparatus for generating EUV radiation, the method comprising the steps of providing a target material dispenser, the target material dispenser comprising a structure defining a cavity arranged to receive target material and an orifice arranged to receive target material from the cavity and to deliver a stream of droplets of target material, providing an electro-actuatable element mechanically coupled to the cavity and arranged to induce velocity perturbations in the stream of droplets based on a drive signal, and supplying a drive signal to the electro-actuatable element for supplying the drive signal, wherein the drive signal includes a substantially constant DC bias.

According to another aspect of an embodiment there is disclosed a method of dispensing target material in an apparatus for generating EUV radiation, the method comprising the steps of providing a target material dispenser, the target material dispenser comprising a structure defining a cavity arranged to receive target material and an orifice arranged to receive target material from the cavity and to deliver a stream of droplets of target material, providing an electro-actuatable element mechanically coupled to the cavity and arranged to induce velocity perturbations in the stream of droplets based on a drive signal, and supplying a drive signal to the electro-actuatable element for supplying the drive signal, wherein a minimum rise/fall time of the drive signal is in the range of about 50 ns to about 100 ns.

According to another aspect of an embodiment there is disclosed a method of dispensing target material in an apparatus for generating EUV radiation, the method comprising the steps of providing a target material dispenser, the target material dispenser comprising a structure defining a cavity arranged to receive target material and an orifice arranged to receive target material from the cavity and to deliver a stream of droplets of target material, providing an electro-actuatable element mechanically coupled to the cavity and arranged to induce velocity perturbations in the stream of droplets based on a drive signal, and supplying a drive signal to the electro-actuatable element for supplying the drive signal, wherein a maximum voltage of the drive signal is limited to limit a flow of current through target material in the orifice.

Further embodiments, features, and advantages of the present invention, as well as the structure and operation of the various embodiments are described in detail below with reference to accompanying drawings.

BRIEF DESCRIPTION OF THE DRAWINGS

The accompanying drawings, which are incorporated herein and form part of the specification, illustrate the methods and systems of embodiments of the invention by way of example, and not by way of limitation. Together with the detailed description, the drawings further serve to explain the principles of and to enable a person skilled in the relevant arts to make and use the methods and systems presented herein. In the drawings, like reference numbers indicate identical or functionally similar elements.

Figure 1:
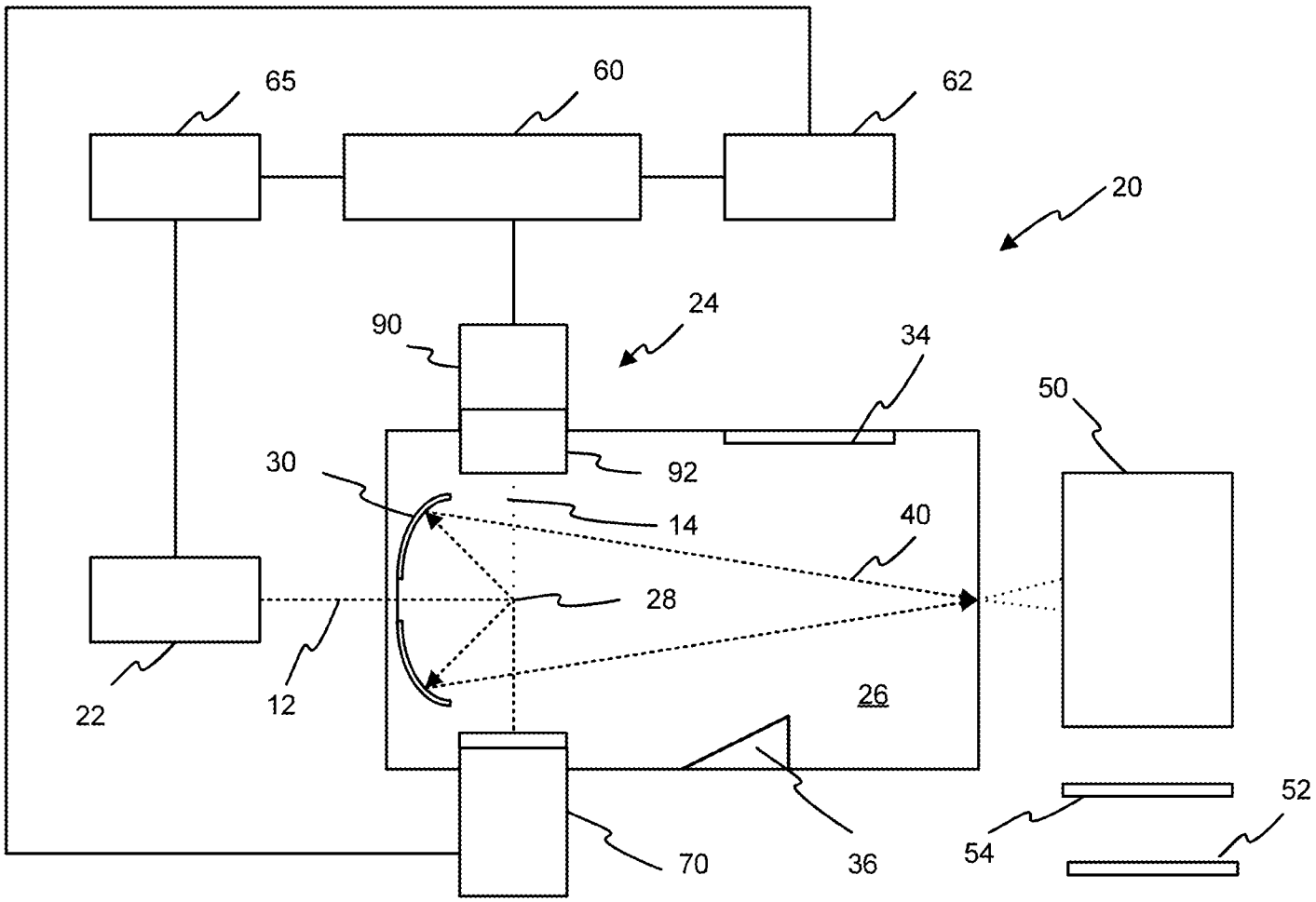
FIG. 1 is a schematic, not-to-scale view of an overall broad conception for a laser-produced plasma EUV radiation source system according to an aspect of the present invention.

Further features and advantages of the invention, as well as the structure and operation of various embodiments of the invention, are described in detail below with reference to the accompanying drawings. It is noted that the invention is not limited to the specific embodiments described herein. Such embodiments are presented herein for illustrative purposes only. Additional embodiments will be apparent to persons skilled in the relevant art based on the teachings contained herein.

DETAILED DESCRIPTION

Various embodiments are now described with reference to the drawings, wherein like reference numerals are used to refer to like elements throughout. In the following description, for purposes of explanation, numerous specific details are set forth in order to promote a thorough understanding of one or more embodiments. It may be evident in some or all instances, however, that any embodiment described below can be practiced without adopting the specific design details described below. In other instances, well-known structures and devices are shown in block diagram form in order to facilitate description of one or more embodiments.

Before describing such embodiments in more detail, however, it is instructive to present an example environment in which embodiments of the present invention may be implemented. In the description that follows and in the claims the terms "up," "down," "top," "bottom," "vertical," "horizontal," and like terms may be employed. These terms are intended to show relative orientation only and not any orientation with respect to gravity.

With initial reference to FIG. 1 there is shown a schematic view of an exemplary EUV radiation source, e.g., a laser produced plasma EUV radiation source 20 according to one aspect of an embodiment of the present invention. As shown, the EUV radiation source 20 may include a pulsed or continuous laser source 22, which may for example be a pulsed gas discharge $CO_2$ laser source producing a beam 12 of radiation. The pulsed gas discharge $CO_2$ laser source may have DC or RF excitation operating at high power and at a high pulse repetition rate.

The EUV radiation source 20 also includes a target delivery system 24 for delivering target material in the form of liquid droplets or a continuous liquid stream. In this example, the target material is a liquid, but it could also be a solid or gas. The target material may be made up of tin or a tin compound, although other materials could be used. In the system depicted the target material delivery system 24 introduces droplets 14 of the target material into the interior of a vacuum chamber 26 to an irradiation region 28 where the target material may be irradiated to produce plasma. In some cases, an electrical charge is placed on the target material to permit the target material to be steered toward or away from the irradiation region 28. It should be noted that as used herein an irradiation region is a region where target material irradiation may occur, and is an irradiation region even at times when no irradiation is actually occurring.

The EUV radiation source 20 may also include an EUV light source controller system 60, which may also include a laser firing control system 65. The EUV radiation source 20 may also include a detector such as a target position detection system which may include one or more droplet imagers 70 that generate an output indicative of the absolute or relative position of a target droplet, e.g., relative to the irradiation region 28, and provide this output to a target position detection feedback system 62.

The target position detection feedback system 62 may use the output of the droplet imager 70 to compute a target position and trajectory, from which a target error can be computed. The target error can be computed on a droplet-by-droplet basis, or on average, or on some other basis. The target error may then be provided as an input to the light source controller 60. In response, the light source controller 60 can generate a control signal such as a laser position, direction, or timing correction signal.

As shown in FIG. 1, the target material delivery system 24 may include a target delivery control system 90. The target delivery control system 90 is operable in response to a signal, for example, the target error described above, or some quantity derived from the target error provided by the system controller 60, to adjust paths of the target droplets 14 through the irradiation region 28. This may be accomplished, for example, by repositioning the point at which a target delivery mechanism 92 releases the target droplets 14. The droplet release point may be repositioned, for example, by tilting the target delivery mechanism 92 or by shifting the target delivery mechanism 92. The target delivery mechanism 92 extends into the chamber 26 and is preferably externally supplied with target material and a gas source to place the target material in the target delivery mechanism 92 under pressure.

More details regarding various droplet dispenser configurations and their relative advantages may be found for example in U.S. Pat. No. 7,872,245, issued on Jan. 18, 2011, titled "Systems and Methods for Target Material Delivery in a Laser Produced Plasma EUV Light Source", U.S. Pat. No. 7,405,416, issued on Jul. 29, 2008, titled "Method and Apparatus For EUV Plasma Source Target Delivery", and U.S. Pat. No. 7,372,056, issued on May 13, 2008, titled "LPP EUV Plasma Source Material Target Delivery System", the contents of each of which are hereby incorporated by reference in their entirety.

Continuing with FIG. 1, the radiation source 20 may also include one or more optical elements. In the following discussion, a collector 30 is used as an example of such an optical element, but the discussion applies to other optical elements as well. The collector 30 may be a normal incidence reflector, for example, implemented as an MLM with additional thin barrier layers, for example $B_4C$, ZrC, $Si_3N_4$ or C, deposited at each interface to effectively block thermally-induced interlayer diffusion. Other substrate materials, such as aluminum (Al) or silicon (Si), can also be used. The collector 30 may be in the form of a prolate ellipsoid, with a central aperture to allow the laser radiation 12 to pass through and reach the irradiation region 28. The collector 30 may be, e.g., in the shape of a ellipsoid that has a first focus at the irradiation region 28 and a second focus at a so-called intermediate point 40 (also called the intermediate focus 40) where the EUV radiation may be output from the EUV radiation source 10 and input to, e.g., an integrated circuit lithography scanner 50 which uses the radiation, for example, to process a silicon wafer workpiece 52 in a known manner using a reticle or mask 54. The silicon wafer workpiece 52 is then additionally processed in a known manner to obtain an integrated circuit device.

Figure 2:
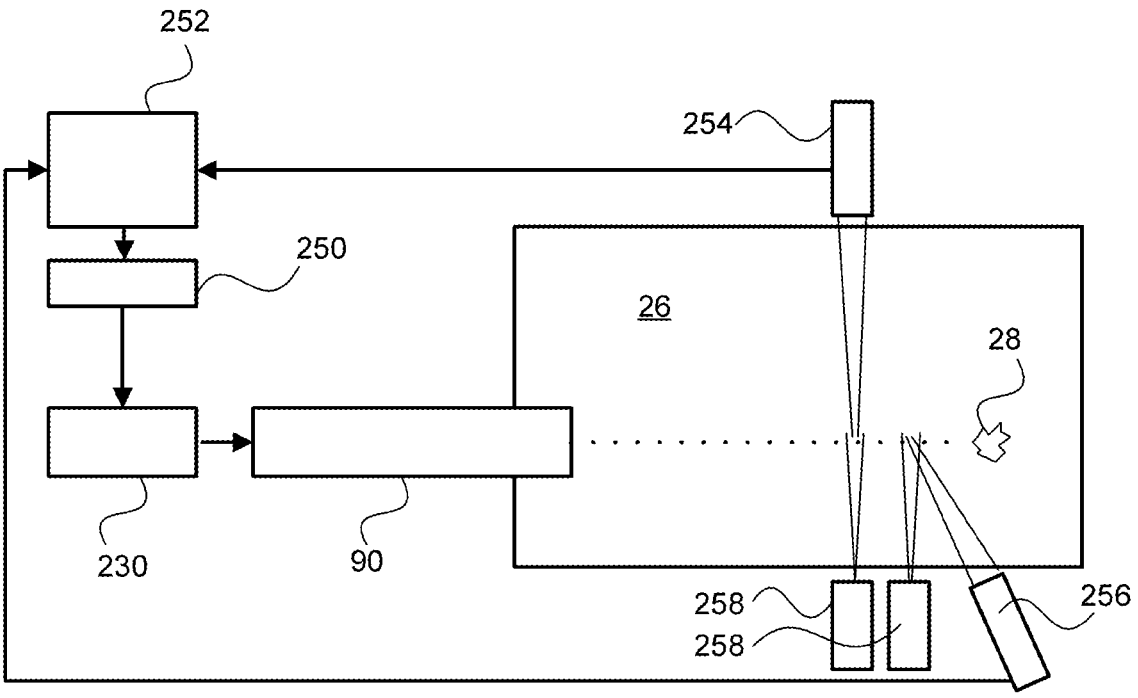
FIG. 2 is a schematic, not-to-scale view of a portion of the system of FIG. 1.

FIG. 2 illustrates the droplet generation system in more detail. The target material delivery system 90 delivers droplets to an irradiation site/primary focus 28 within chamber 26. A drive signal generator 230 provides a drive waveform to an electro-actuatable element in the droplet generator 90 which induces a velocity perturbation into the droplet stream. A drive waveform may comprise a single sine wave, a combination of several sine waves with different frequencies, or a combination of sine waves and pulse waves. By carefully selecting parameters of the drive waveform one can impose the velocity perturbations on the molten tin jet that result in a formation of the droplets at a frequency of 40-100 kHz at a typical distance of 5-20 cm from the droplet generation system that are required for the normal operation of the EUV light source. The drive signal generator 230 operates under the control of a controller 250 at least partially on the basis of data from a data processing module 252. The data processing module 252 receives data one or more detectors. In the example shown, the detectors include a camera 254 and a photodiode 256. The droplets are illuminated by one or more lasers 258. In this typical arrangement, the detectors detect/image droplets at a point in the stream where coalescence is expected to have occurred. Also, the detectors and lasers are arranged outside of the vacuum chamber 26 and view the stream through windows in the walls of vacuum chamber 26.

The target material delivery system 90 may include a reservoir holding a fluid, e.g. molten tin, under pressure. The reservoir is in fluid communication with a cavity terminating in a nozzle having an orifice allowing the pressurized fluid in the reservoir to flow through the orifice establishing a continuous stream which subsequently breaks into a plurality of microdroplets which then coalesce into larger droplets.

Figure 3A:
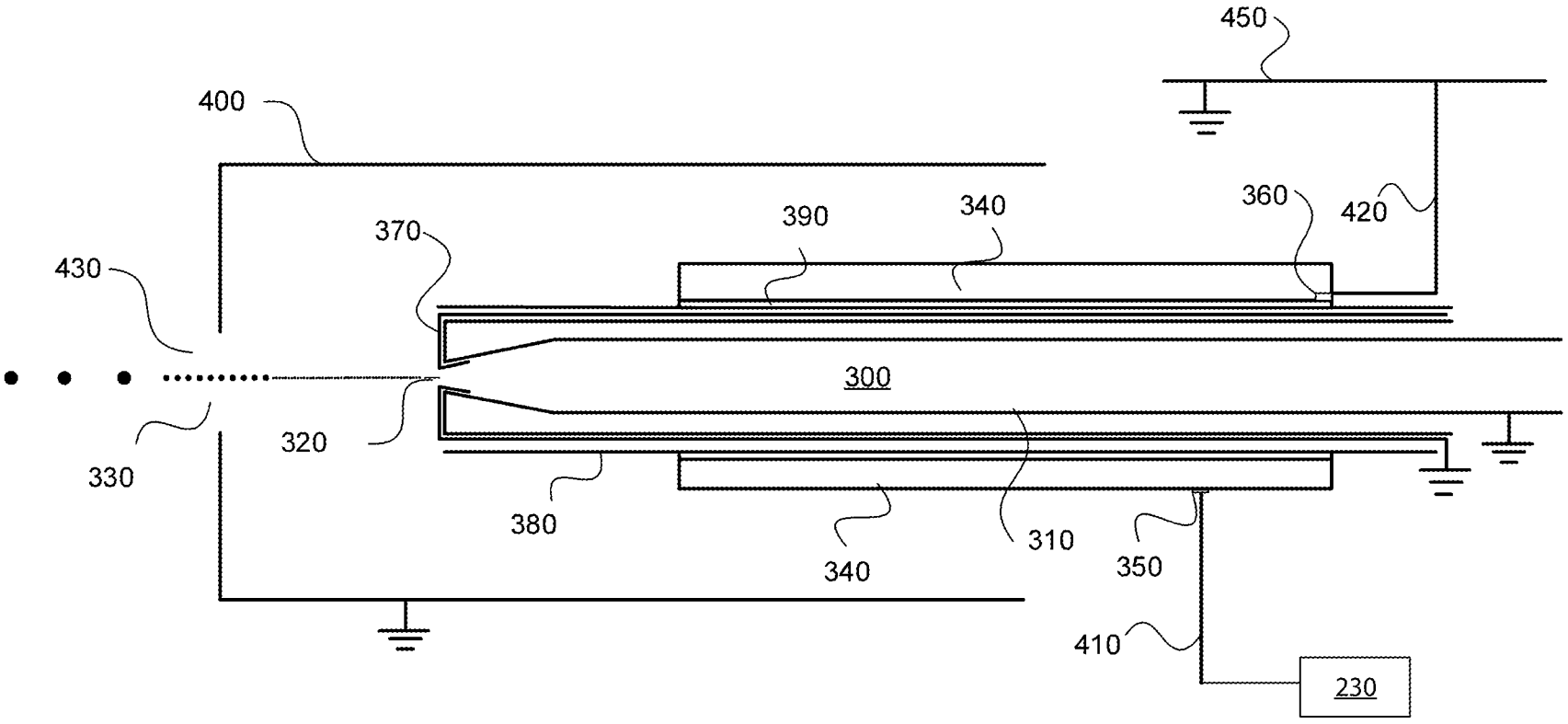
FIG. 3A is a diagram of a droplet generator nozzle assembly according to an aspect of an embodiment.

Such an arrangement is shown in FIG. 3A. In FIG. 3A, a structure defining a cavity 300 is in the form of a tube or capillary 310. The capillary 310 terminates in a nozzle having an orifice 320. A column of molten target material in the cavity 300 is under pressure and expelled from the orifice 320 in a stream and breaks up into droplets 330. As mentioned above, velocity perturbations in the column of target material in the cavity 300 are induced by an electro-actuatable element 340 which, in the example shown, a cylindrical. The electro-actuatable element 340 may be, for example, a piezoelectric element. In the configuration shown the electro-actuatable element 340 has an electrode 350 on its outer diameter and an electrode 360 on its inner diameter. The electrode 350 is connected to a drive signal source 230 by a connection 410. The connection 410 may be an RF coaxial cable (for example, with 50 Ohm nominal impedance) terminated at the outer electrode 350. The electrode 360 is connected to ground potential by a connection 420. The drive signal source 230 applies a drive signal to the element 340 causing a change in dimension of the electro-actuatable element 340 which is mechanically coupled to the target material in the cavity 300.

Also as shown, the capillary 310 is coated with a conductive coating 370 the which may be, for example, chromium. Also, the conductive coating 370 may be coated by an insulating coating 380. The insulating coating 380 can be arranged to cover only a part of conductive coating 370, for example in the area axially coextensive with the electro-actuatable element 340. The purpose of the insulating coating 380 is to provide an insulating layer between the PZT electrode 360 and conductive coating 370. The electro-actuatable element 340 is bonded to the conductive coating or to the insulating coating, if it is present, by an adhesive material forming a bonding layer 390. The end of the droplet generator may be enclosed in a droplet generator cage 400. The purpose of the conductive coating 370 is to shield target material leaving the orifice 320 from the electrostatic field created by the uncompensated surface charge on the capillary so that the droplets do not become electrically charged, repel each other, and fail to coalesce. The conductive coating 370 preferably has a resistivity not greater than about 1E-06 Ohm-m. The conductive coating may be grounded to the tin stream through the orifice. In addition to the grounding path at the orifice, the conductive coating 370 may also have a dedicated connection to the grounded droplet generator housing 450.

As mentioned, there may be a tendency for the droplet stream 330 to drift sideways so that eventually the stream clips the edges of an exit aperture 430 in the droplet generator cage 400. One mechanism which appears to cause drift of the droplet stream is the formation of SnOx particles in the nozzle orifice. The formation of SnOx particles in the nozzle orifice is promoted by a current having RF components (referred to as an RF signal herein) flowing through the nozzle orifice by means of an electrolytic, electrophoretic, or thermal mechanism such as Joule heating.

One source of an RF current flowing through the nozzle orifice appears to be current flowing through the conductive coating on the nozzle and continuing to molten tin in the nozzle. One reason for the existence of this RF current is that for higher frequency components, the impedance of the parasitic capacitance between an electro-actuatable element in the form of a piezoelectric tube around the capillary and the conductive coating through the bonding layer (and the insulating layer if present) is smaller than for lower frequency components, whereas the mostly inductive impedance of the connection 420 is larger. Thus, larger portion of the return current is directed towards the lower impedance path, i.e. through the parasitic capacitance and through the tin inside of the nozzle.

It is thus desirable to reduce the RF current flowing through the nozzle by reducing a parasitic inductance on the return (grounding) connection 420. One means to reduce this inductance is by providing a very short connection 420 for the inner electrode 360. For example, the physical length of this return path for prior implementations may be in the range of about 50 cm to about 100 cm. This may correspond to a parasitic inductance on the range of about 0.5 μH to about 2 μH. A shorter connection such as 10 cm or less may reduce the parasitic inductance in various implementations of a droplet generator.

More specifically, the electrode 360 can be grounded by providing an electrical connection to the droplet generator cage 400 that is installed on the nozzle and is itself grounded. In this case the length of the electrical path to the ground is reduced to about 3 cm and the parasitic inductance associated with this connection is reduced to about 35 nH. The electrode 360 can also be grounded by providing a short electrical wire connection to other grounded elements such as heater blocks of the droplet generator. The inductance of the grounding connection 420 can also be achieved by grounding the inner electrode 360 to the metal housing of the droplet generator.

There are thus multiple paths by which current may flow in and around the droplet generator components. From the point of view of the key functionality of the droplet generator these different paths are essentially equivalent. However, some of these paths result in undesirable flow of current through tin in the nozzle orifice, thus promoting the formation of SnOx particles obstructing the tin flow. The goal is thus to cause more of the current to flow through paths which do not involve the tin in the nozzle orifice. As set forth above, one measure to achieve this may be to reduce the inductance of some of the other paths to ground. Another way to accomplish this would be to control the frequency of the drive signal. To the extent that the impedance of the paths through the tin in the nozzle orifice is primarily capacitive, and the impedance of the other paths is primarily inductive, then taking measures to limit high frequency components in the drive signal will tend to make it so that the through-the-nozzle path has higher impedance.

Figure 3B:
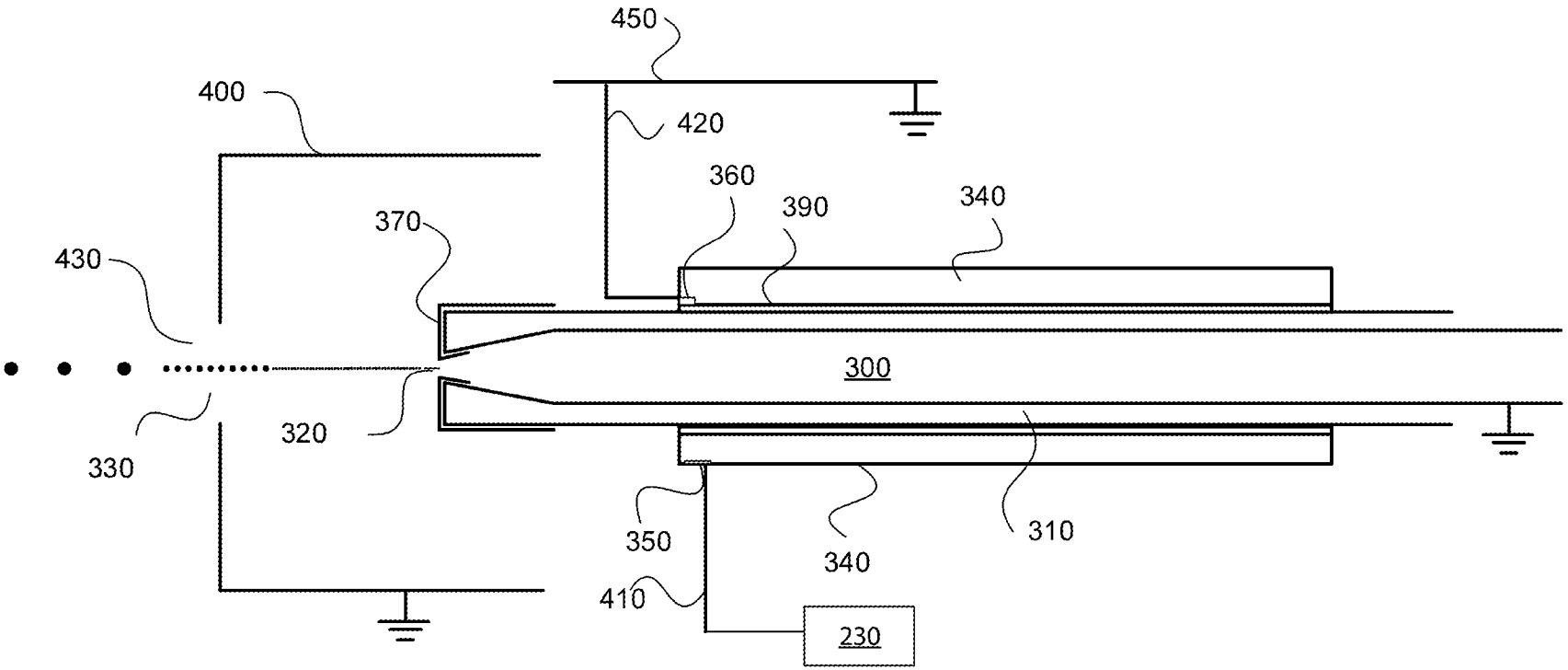
FIG. 3B is a diagram of a droplet generator nozzle assembly according to another aspect of an embodiment.

FIG. 3B shows an alternative of the arrangement of FIG. 3A in which the conductive coating 370 is modified and the connections 350, 360 to the electro-actuatable element 340 are arranged to be closer to the orifice 320 end of the capillary 310. In the configuration of FIG. 3B parts of the capillary 310 have no conductive coating, e.g., the capillary is masked during axisymmetric Cr sputtering, to remove the small gap capacitor between the inner piezoelectric electrode and conductive coating 370 while maintaining a conductive path between for the capillary 310 front surface and orifice 320 tin to prevent microdroplet charging that makes free-flight coalescence difficult. Also in FIG. 3B the connections 350, 360 to the electro-actuatable element 340 are repositioned, i.e., flipped such that the inner electrode 360 wraps around the forward facing surface (as opposed to the rear facing surface) of the electro-actuatable element 340 to suppress the electromagnetic field known to charge microdroplets making free-flight coalescence difficult.

Thus, another method to mitigate the drift of the droplets is to reduce the high frequency content of the modulation signal. This can be done, for example, by increasing the rise time and the fall time of the pulse wave component of the modulation signal to avoid high frequency Fourier components in a sharper transition or by limiting the maximum frequency of the sine waves if the drive signal does not contain pulse wave components. Thus, for example it is desirable for this purpose that the rise and/or fall time of pulses in the drive signal be in the range of about 50 ns to about 100 ns and the sine wave frequencies are limited to about 3.5 MHz to about 7 MHz to mitigate the drift effect. Again, this is because at lower frequencies the impedance of the connection 420 is low, whereas the impedance of the path including the parasitic capacitance of the piezoelectric element and the tin in the nozzle is significantly higher. Therefore the magnitude of the RF current flowing through the tin in the nozzle is reduced. Also, the magnitude of the drive signal can be reduced. As noted however, the availability of these techniques may be limited by the consideration that they may reduce droplet coalescence efficiency.

This method of mitigating the drift of the droplet stream has the advantage that it does not require changes in the hardware of the droplet generator. It has the disadvantage, however, that it reduces the range of choices of frequency components of signals available for achieving optimum coalescence of the droplets. This drive signal is typically optimized to obtain shortest coalescence possible and the higher frequency components usually conduce this result. Increasing the energy of high frequency components of the excitation waveform also increases droplet timing stability.

Figure 4A:
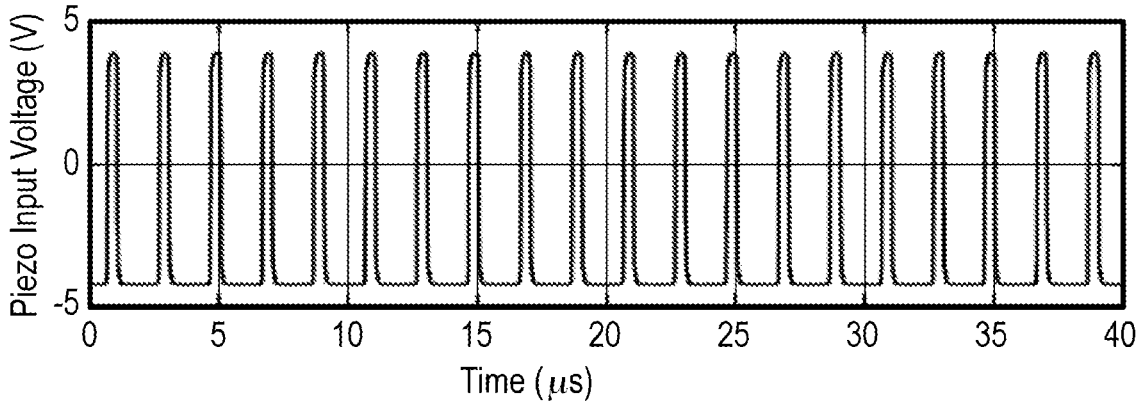
FIG. 4A depicts an excitation waveform of a piezoelectric element in a droplet generator nozzle assembly.
Figure 4B:
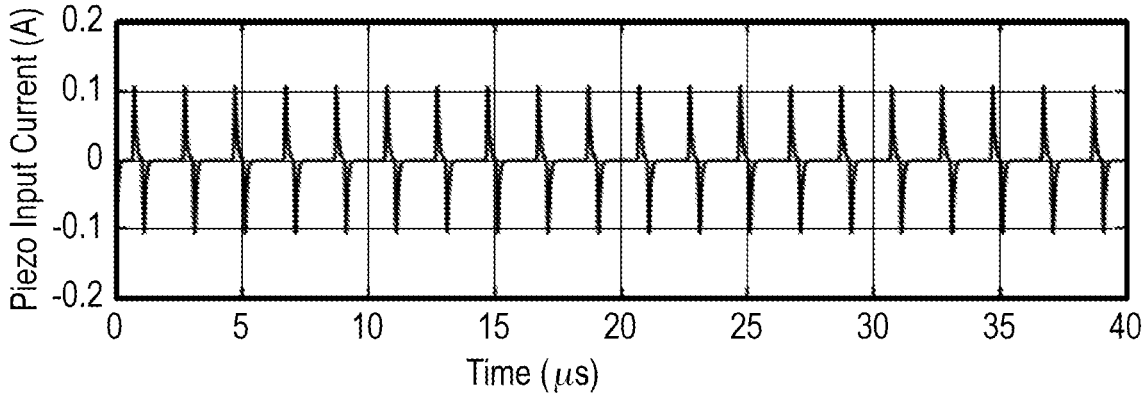
FIG. 4B depicts a resulting current in the piezoelectric element.
Figure 4C:
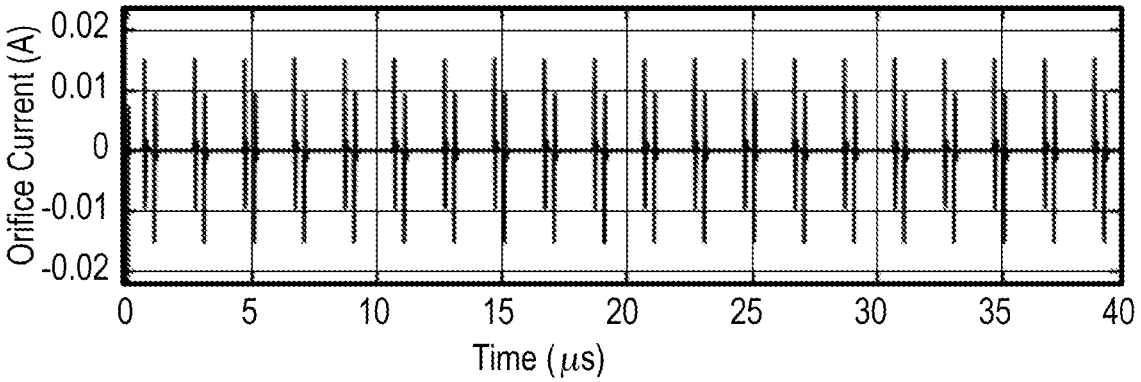
FIG. 4C depicts a resulting simulated current through the orifice in the droplet generator nozzle assembly according to an aspect of the present invention.

FIGS. 4A, 4B, and 4C shows examples of simulated current/voltage waveforms during droplet generator operation where a pulsed signal is used for tin jet modulation. FIG. 4A shows an input voltage waveform of the drive signal for the electro-actuatable element, in this case a piezoelectric element, and FIG. 4B shows the resultant input current. FIG. 4C shows the resultant orifice current. As can be seen, voltage/current spikes are produced during this operation. Parasitic electrical current spikes propagating through molten Sn in the nozzle promote SnOx formation. These are referred to Orifice Current waveform in FIG. 4C.

SnOx formation is stimulated by these current spikes as described above. Thus, the problem of SnOx formation in the nozzle orifice may be mitigated by control (i.e., reduction including elimination) of these current spikes.

As mentioned above, one measure to control these parasitic current spikes is providing a low impedance electrical connection for the electro-actuatable element inner electrode. A long (about 0.5 m to about 1 m) wire typically runs through the whole body of the droplet generator to an RF type connector (for example, a Bayonet Nut Connector (BNC)) at the end of the wire. The electrical inductance of the wire is about 0.5 μH, which leads to voltage/current spikes when a fast-rise (about 10 ns to about 20 ns rise time) drive signal is sent through it. Providing an alternative, low-inductance electrical connection of the electro-actuatable element to the ground with a short (less than about 10 cm) wire helps to reduce these spikes and eliminate the drift problem.

When the current spikes that lead to SnOx formation when a pulsed modulation signal waveform is used are of a certain polarity, DC biasing the drive signal to the opposite polarity may be used to prevent these spikes from achieving values that would otherwise contribute to SnOx formation. For example, when the current spikes are positive, negative biasing in the range of about −2 V to about −10V can be applied, and vice versa.

The present invention has been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The foregoing description of the specific embodiments will so fully reveal the general nature of the invention that others can, by applying knowledge within the skill of the art, readily modify and/or adapt for various applications such specific embodiments, without undue experimentation, without departing from the general concept of the present invention. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance. The breadth and scope of the present invention should not be limited by any of the above-described exemplary embodiments, but should be defined only in accordance with the following claims and their equivalents.

Other aspects of the invention are set out in the following numbered clauses.

1. Apparatus for generating EUV radiation comprising:

a target material dispenser, the target material dispenser comprising a structure defining a cavity arranged to receive target material and an orifice arranged to receive target material from the cavity and to deliver a stream of droplets of target material;

an electro-actuatable element mechanically coupled to the cavity and arranged to induce velocity perturbations in the stream of droplets based on a drive signal; and a drive signal generator electrically coupled to the electro-actuatable element for supplying the drive signal, electrical connections with the electro-actuatable element being arranged to control an amount of current flowing through the target material at the orifice.

2. Apparatus as in clause 1 wherein the electrical connections with the electro-actuatable element are arranged to provide a low impedance path between the electro-actuatable element and ground that does not pass through the target material at the orifice.

3. Apparatus as in clause 1 wherein the structure defining a cavity comprises a cylindrical tube and the electro-actuatable element comprises a cylindrical piezoelectrical element arranged around the cylindrical tube and having an inner surface connected to ground by a low impedance path.

4. Apparatus as in clause 3 wherein the inner surface is connected to ground at a portion of the electro-actuatable element most proximate to the orifice.

5. Apparatus as in clause 1 wherein the target material dispenser further comprises a conductive coating around at least part of the structure defining a cavity.

6. Apparatus as in clause 5 wherein the conductive coating has a resistivity less than about 1E-06 Ohm-m.

7. Apparatus as in clause 5 wherein the conductive coating is limited to an area of the structure defining including the orifice.

8. Apparatus as in clause 5 wherein the electro-actuatable element is positioned around a first axial portion of the cavity not having a conductive coating.

9. Apparatus as in clause 5 wherein the conductive coating is connected to ground through a low impedance path.

10. Apparatus as in clause 5 further comprising an insulating coating on the conductive coating.

11. Apparatus as in clause 1 wherein the drive signal generator is electrically coupled to the electro-actuatable element through an RF coaxial cable terminated directly at the electro-actuatable element.

12. Apparatus for generating EUV radiation comprising:

a target material dispenser comprising a structure defining a cavity arranged to receive target material and an orifice arranged to receive target material from the cavity and to deliver a stream of droplets of target material;

an electro-actuatable element mechanically coupled to the cavity and arranged to induce velocity perturbations in the stream of droplets based on a drive signal; and a drive signal generator electrically coupled to the electro-actuatable element for supplying the drive signal, wherein the highest frequency component of the drive signal is limited to a value in a range of about 3.5 MHz to about 7 MHz.

13. Apparatus as in clause 12, wherein electrical connections with the electro-actuatable element are arranged to control an amount of current flowing through the target material at the orifice.

14. Apparatus for generating EUV radiation comprising:

a target material dispenser comprising a structure defining a cavity arranged to receive target material and an orifice arranged to receive target material from the cavity and to deliver a stream of droplets of target material;

an electro-actuatable element mechanically coupled to the cavity and arranged to induce velocity perturbations in the stream of droplets based on a drive signal; and a drive signal generator electrically coupled to the electro-actuatable element for supplying the drive signal, wherein a minimum rise/fall time of the drive signal is in the range of about 50 ns to about 100 ns.

15. Apparatus for generating EUV radiation comprising:

a target material dispenser comprising a structure defining a cavity arranged to receive target material and an orifice arranged to receive target material from the cavity and to deliver a stream of droplets of target material;

an electro-actuatable element mechanically coupled to the cavity and arranged to induce velocity perturbations in the stream of droplets based on a drive signal; and a drive signal generator electrically coupled to the electro-actuatable element for supplying the drive signal, wherein a maximum voltage of the drive signal is limited to limit a flow of current through target material in the orifice.

16. Apparatus for generating EUV radiation comprising:

a target material dispenser comprising a structure defining a cavity arranged to receive target material and an orifice arranged to receive target material from the cavity and to deliver a stream of droplets of target material;

an electro-actuatable element mechanically coupled to the cavity and arranged to induce velocity perturbations in the stream of droplets based on a drive signal; and a drive signal generator electrically coupled to the electro-actuatable element for supplying the drive signal, wherein the drive signal includes a substantially constant DC bias.

17. Apparatus as in clause 16 wherein the bias is negative.

18. Apparatus as in clause 16 wherein the bias is positive.

19. Apparatus as in clause 16 wherein the bias is negative if the drive waveform is comprised of pulses with positive polarity and positive if the drive waveform is comprised of pulses with polarity plurality.

20. Apparatus for generating EUV radiation comprising:

a target material dispenser, the target material dispenser comprising a structure defining a cavity arranged to receive target material and an orifice arranged to receive target material from the cavity and to deliver a stream of droplets of target material;

an electro-actuatable element mechanically coupled to the cavity and arranged to induce velocity perturbations in the stream of droplets based on a drive signal; and a drive signal generator electrically coupled to the electro-actuatable element for supplying the drive signal, electrical connections with the electro-actuatable element being arranged and a parameter of the drive signal being selected to control an amount of current flowing through the target material at the orifice.

21. A method of dispensing target material in an apparatus for generating EUV radiation, the method comprising the steps of:

providing a target material dispenser, the target material dispenser comprising a structure defining a cavity arranged to receive target material and an orifice arranged to receive target material from the cavity and to deliver a stream of droplets of target material;

providing an electro-actuatable element mechanically coupled to the cavity and arranged to induce velocity perturbations in the stream of droplets based on a drive signal; and supplying a drive signal to the electro-actuatable element for supplying the drive signal, wherein the drive signal includes a substantially constant DC bias.

22. A method of dispensing target material in an apparatus for generating EUV radiation, the method comprising the steps of:

providing a target material dispenser, the target material dispenser comprising a structure defining a cavity arranged to receive target material and an orifice arranged to receive target material from the cavity and to deliver a stream of droplets of target material;

providing an electro-actuatable element mechanically coupled to the cavity and arranged to induce velocity perturbations in the stream of droplets based on a drive signal; and supplying a drive signal to the electro-actuatable element for supplying the drive signal, wherein a minimum rise/fall time of the drive signal is in the range of about 50 ns to about 100 ns.

23. A method of dispensing target material in an apparatus for generating EUV radiation, the method comprising the steps of:

providing a target material dispenser, the target material dispenser comprising a structure defining a cavity arranged to receive target material and an orifice arranged to receive target material from the cavity and to deliver a stream of droplets of target material;

providing an electro-actuatable element mechanically coupled to the cavity and arranged to induce velocity perturbations in the stream of droplets based on a drive signal; and supplying a drive signal to the electro-actuatable element for supplying the drive signal, wherein a maximum voltage of the drive signal is limited to limit a flow of current through target material in the orifice.

Other implementations are within the scope of the claims.

The invention claimed is:

1. Apparatus for generating EUV radiation comprising:

a target material dispenser, the target material dispenser comprising a structure defining a cavity arranged to receive target material and an orifice arranged to receive target material from the cavity and to deliver a stream of droplets of target material;

an electro-actuatable element mechanically coupled to the cavity and arranged to induce velocity perturbations in the stream of droplets based on a drive signal; and a drive signal generator electrically coupled to the electro-actuatable element for supplying the drive signal, electrical connections with the electro-actuatable element being arranged to control an amount of current flowing through the target material at the orifice.

2. Apparatus as in claim 1 wherein the electrical connections with the electro-actuatable element are arranged to provide a low impedance path between the electro-actuatable element and ground that does not pass through the target material at the orifice.

3. Apparatus as in claim 1 wherein the structure defining a cavity comprises a cylindrical tube and the electro-actuatable element comprises a cylindrical piezoelectrical element arranged around the cylindrical tube and having an inner surface connected to ground by a low impedance path.

4. Apparatus as in claim 3 wherein the inner surface is connected to ground at a portion of the electro-actuatable element most proximate to the orifice.

5. Apparatus as in claim 1 wherein the target material dispenser further comprises a conductive coating around at least part of the structure defining a cavity.

6. Apparatus as in claim 5 wherein the conductive coating has a resistivity less than about 1E-06 Ohm-m.

7. Apparatus as in claim 5, wherein the conductive coating is limited to an area of the structure defining the orifice.

8. Apparatus as in claim 5, wherein the electro-actuatable element is positioned around a first axial portion of the cavity not having a conductive coating.

9. Apparatus as in claim 5 wherein the conductive coating is connected to ground through a low impedance path.

10. Apparatus as in claim 5, further comprising an insulating coating on the conductive coating.

11. Apparatus as in claim 1 wherein the drive signal generator is electrically coupled to the electro-actuatable element through an RF coaxial cable terminated directly at the electro-actuatable element.

12. Apparatus as in claim 1, wherein a highest frequency component of the drive signal is limited to a value in a range of about 3.5 MHz to about 7 MHz.

13. Apparatus as in claim 1, wherein a minimum rise/fall time of the drive signal is in the range of about 50 ns to about 100 ns.

14. Apparatus as in claim 1, wherein a parameter of the drive signal is selected to further control the amount of current flowing through the target material at the orifice.

15. Apparatus for generating EUV radiation comprising:

a target material dispenser comprising a structure defining a cavity arranged to receive target material and an orifice arranged to receive target material from the cavity and to deliver a stream of droplets of target material;

an electro-actuatable element mechanically coupled to the cavity and arranged to induce velocity perturbations in the stream of droplets based on a drive signal; and a drive signal generator electrically coupled to the electro-actuatable element for supplying the drive signal, wherein a maximum voltage of the drive signal is limited to limit a flow of current through target material in the orifice.

16. Apparatus for generating EUV radiation comprising:

a target material dispenser comprising a structure defining a cavity arranged to receive target material and an orifice arranged to receive target material from the cavity and to deliver a stream of droplets of target material;

an electro-actuatable element mechanically coupled to the cavity and arranged to induce velocity perturbations in the stream of droplets based on a drive signal; and a drive signal generator electrically coupled to the electro-actuatable element for supplying the drive signal, wherein the drive signal includes a substantially constant DC bias.

17. Apparatus as in claim 16 wherein the bias is negative if the drive waveform is comprised of pulses with positive polarity and positive if the drive waveform is comprised of pulses with negative polarity.

18. A method of dispensing target material in an apparatus for generating EUV radiation, the method comprising the steps of:

providing a target material dispenser, the target material dispenser comprising a structure defining a cavity arranged to receive target material and an orifice arranged to receive target material from the cavity and to deliver a stream of droplets of target material;

providing an electro-actuatable element mechanically coupled to the cavity and arranged to induce velocity perturbations in the stream of droplets based on a drive signal; and supplying a drive signal to the electro-actuatable element, wherein the drive signal includes a substantially constant DC bias.

19. The method as in claim 18, wherein a minimum rise/fall time of the drive signal is in the range of about 50 ns to about 100 ns.

20. A method of dispensing target material in an apparatus for generating EUV radiation, the method comprising the steps of:

providing a target material dispenser, the target material dispenser comprising a structure defining a cavity arranged to receive target material and an orifice arranged to receive target material from the cavity and to deliver a stream of droplets of target material;

providing an electro-actuatable element mechanically coupled to the cavity and arranged to induce velocity perturbations in the stream of droplets based on a drive signal; and supplying a drive signal to the electro-actuatable element, wherein a maximum voltage of the drive signal is limited to limit a flow of current through target material in the orifice.

* * * * *